US007856993B2

(12) United States Patent
French-Artis

(10) Patent No.: US 7,856,993 B2
(45) Date of Patent: Dec. 28, 2010

(54) DECORATIVE NAIL WITH SEALED CAVITY

(76) Inventor: Traska J. French-Artis, 946 S. Armour, Wichita, KS (US) 67207

( * ) Notice: Subject to any disclaimer, the term of this patent is extended or adjusted under 35 U.S.C. 154(b) by 138 days.

(21) Appl. No.: 12/173,597

(22) Filed: Jul. 15, 2008

(65) Prior Publication Data

US 2008/0289643 A1 Nov. 27, 2008

Related U.S. Application Data

(63) Continuation of application No. 10/878,948, filed on Jun. 29, 2004, now abandoned.

(51) Int. Cl.
*A45D 29/00* (2006.01)

(52) U.S. Cl. ..... 132/73

(58) Field of Classification Search ..... 132/73, 132/75, 73.5

See application file for complete search history.

(56) References Cited

U.S. PATENT DOCUMENTS

| | | | | |
|---|---|---|---|---|
| 6,467,489 | B1 * | 10/2002 | Christiansen | 132/73 |
| 2003/0154995 | A1 * | 8/2003 | Chang | 132/73 |
| 2004/0194794 | A1 * | 10/2004 | Kim | 132/73 |

* cited by examiner

*Primary Examiner*—Robyn Doan
*Assistant Examiner*—Brianne O'Neill
(74) *Attorney, Agent, or Firm*—Dunlap Codding, P.C.

(57) ABSTRACT

A method of decorating a natural nail by with a substantially clear nail body having a nail attachment portion attachable to a natural nail and a nail extension portion which extends beyond a terminating edge of the natural nail when the nail attachment portion is attached to the natural nail. The nail body has a cavity formed therein solely within the nail extension portion, a volume of fluid disposed in the cavity, and at least one opaque decorative element suspended in the fluid so as to be visible through the nail extension portion of the nail body. The nail attachment portion is attached to the natural nail such that the nail extension portion extends beyond the terminating edge of the natural nail.

3 Claims, 5 Drawing Sheets

DECORATIVE NAIL WITH SEALED CAVITY

CROSS REFERENCE TO RELATED APPLICATIONS

This application is a continuation of U.S. Ser. No. 10/878,948, filed Jun. 29, 2004 now abandoned.

BACKGROUND OF THE INVENTION

Decorative fingernails are highly sought-after accessories. There are numerous instances of prior art dedicated toward the creation of unique fingernail displays. Methods of applying coloration, designs and patterns are replete throughout the industry.

At least one invention has contemplated the idea of having three-dimensional features applied to fingernails. This is disclosed in U.S. Pat. No. 6,631,723 (Mullin), which allows three-dimensional objects can placed directly on the person's fingernail. While three-dimensional objects may provide a unique visual experience, it is clear that problems exist with regard to the wear and tear that three-dimensional protrusions the subject to.

Visual displays that follow the shape of the outer side of a fingernail have been contemplated, in which a portion of the fingernail is removed and replaced with a separate object or display. U.S. Pat. No. Des. 303,161 (Thompkins) discloses a small clock/calendar display that is inserted into a cutout of a fingernail. U.S. Pat. No. 6,328,039 (Chang) discloses a fingernail that defines a small reservoir or recessed area, into which loose objects can be placed. This invention contemplates a removable cover that fits over the recessed area to form an enclosed pocket.

Prior art does not suggest or teach the formation of a cavity that is capable of holding liquid and other ornamental items. A removable cap, as that contemplated in Chang is prone to leakage.

The present invention offers an alternative to prior fingernail art, in that a fingernail is provided with a secure and sealed cavity, which is capable of receiving and holding a liquid media, along with any other decorative items. The effect of the present invention is to provide a method of making and providing a snow-globe effect, in which a large cavity area is available to contain the suspension matrix and reflective items.

The present invention is also able to utilize existing fingernails, with the addition of a secondary layer or sheet, to form one of the walls of the cavity. In addition, the present invention may comprise a single piece nail that is formed so as to define a sealable cavity.

SUMMARY OF THE INVENTION

Figure 1:
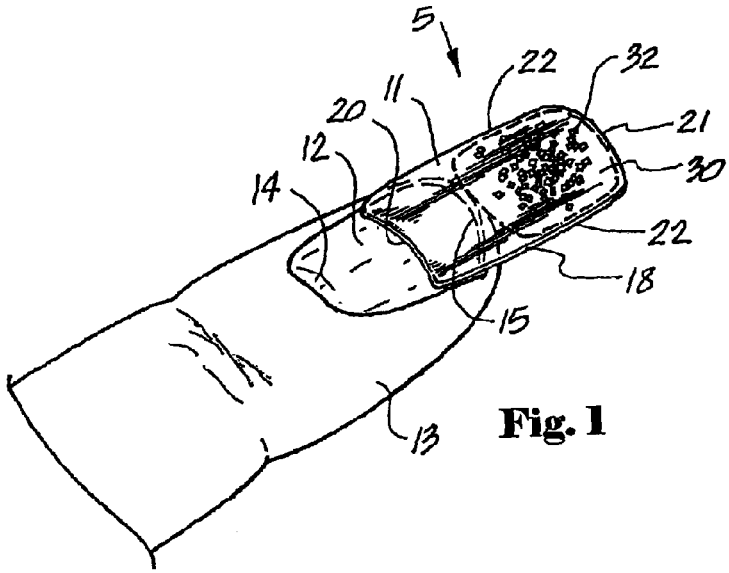
FIG. 1 is a perspective view of the attachment fingernail, indicating the outline of the cavity, as the attachment fingernail appears when placed on a person's finger.

This attachment fingernail is intended to provide a means whereby a cavity is made available into which ornamental objects and/or material can the inserted, with the cavity capable of being sealed so as to prevent the inserted matter from escaping. The cavity is capable of receiving liquids, which are also able to contain glitter or other floating objects, that when placed within the liquid, allow the nail to function effectively as a typical snow globe. Bubbles of gas may also remain within the cavity, but are not required.

The cavity is formed by the placement of a fingernail and secondary sheet, so that when these two objects are placed together, they contact each other at points where adhesive material has placed upon the nail. Typically, the adhesive product is placed around the periphery of the nail on its bottom or underneath flat side, with the secondary sheet adhering to such areas upon contact. The size and configuration of the cavity is determined by the area of adhesive on the nail.

The secondary sheet is typically larger in area than the nail, so that the secondary sheet extends outward beyond the sides of the nail. This requires excess portions of the secondary sheet to be removed. Once the excess portions are removed, a slit either remains or is created through the secondary sheet, allowing the injection of objects into the cavity that is formed by the space between the secondary sheet and attachment nail.

The materials able to be injected into the nail cavities include liquid suspensions, in which glitter and other floating objects may be mixed. Bubbles and various colored liquids may also be used. Ornamental objects such as small beads or other desirable shapes may also be placed within the fingernail cavity, with a supporting liquid present as desired.

Liquids of varied viscosities may be used, including water, but viscous substances such as gels may also be used. In addition to liquids, particulate matter such as fine-grained sand may also be placed into the cavity. This can create a desirable and unique pattern for each nail, where the sand comprises various colors and is added a single color at a time to form colored bands as they are deposited within the cavity. If the cavity is sealed suitably, with no appreciable airspace, the sand will generally maintain its position in relation to sand grains of other colors.

The slit opening into the cavity may be in the middle portion of the nail, or it may be at a peripheral end of the nail. Likewise, the cavity may comprise a portion of the total available area of the nail, leaving an unused area that allows it to be attached to the nail where there is no cavity between the actual fingernail and the attachment nail. In addition, the cavity may be defined as an area that extends across virtually the entire available surface of the attachment nail, with a cavity extending both above the natural fingernail, and also in the portion of the attachment nail extending outward beyond the person's natural fingernail.

The cavity may also comprise a portion of the nail extending the length of the nail bed, leaving no cavity between the actual nail tip and the attachment tip. This attachment nail is suitable on both fingers and toes, with the only difference generally comprising the size of the fingernails.

A novel method of creating the attachment nail with a cavity is also disclosed, in which the cavity is first formed, the material is added, and the opening through which it is added is sealed.

The secondary sheet may be a flexible material, that is either transparent or translucent: allowing the matter within it to be seen with ease. In addition, the underlying secondary sheet may have a preprinted pattern on it, that provides a background for the cavity defined immediately above it.

Various types of plastic and vinyl sheeting are available as secondary sheets, allowing use with existing types of attachment nails. In addition, more rigid secondary sheets may be provided, that are pre-formed as to their shape and configuration as compared to the actual attachment nail. These rigid secondary sheets may offer a concave curvature toward the concave curvature of the attachment nail. When these two items are placed together: an elongated bowl or convex cavity will be created as seen when viewing the attachment nail and secondary sheets in a cross-sectional manner. If the secondary sheet exhibits a similar curvature to the attachment nail, but where the attachment nail exhibits a greater degree of curvature, an arcual cavity is able to be formed between these two objects when they are placed together.

Lastly, the nail may be pre-formed as a single piece: with the cavity being created at the time the attachment nail is made, so that there is no secondary sheet, and the attachment nail is created with the cavity defined therein in accordance with its manufactured specifications. The single piece nail has a defined opening that allows contents to be placed within the cavity. The cavity is closed by placing a plug within the opening, to seal said opening, and maintain the contents of the cavity therein.

DETAILED DESCRIPTION OF THE PREFERRED EMBODIMENTS

Referring now to FIG. 1, an attachment fingernail 5 is shown, and is defined by side edges 22, a peripheral edge 21, and an attachment edge 20. Also shown in FIG. 1 is a human finger 13, in which the natural fingernail 12 is shown, with the cuticle 14 and the terminating edge 15 indicated as well. The attachment fingernail 5 is secured to the natural fingernail 12, and serves as an extension of the natural fingernail 12. The attachment edge 20 comprises the terminating edge of the nail 18 that makes physical contact with the natural fingernail 12. The peripheral edge 21 comprises the limit of the extension of the nail 18 from the natural fingernail 12. The inner side, also referred to as the underneath side 16, is the portion of the nail opposite of the outer side 11 typically viewed when worn. The inner or underneath side 16 is depicted in FIGS. 2-7 and 9-15.

Referring again to FIG. 1, a cavity 30 containing ornamental objects, such as glitter 32, is shown. This improved attachment nail 5 offers the person wearing it to display unique ornamental patterns and designs that are capable of modification as the fingernail 5 reorients to differing positions, causing the ornamental objects contained therein to move about the confines of the cavity 30.

This decorative attachment fingernail 5 comprises a nail 18 and a secondary sheet 40. The nail 18 is also known as a "fingernail extension." Other terminology that applies to the nail 18 are called "tips" which cover a portion of the natural nail 12, as shown in FIG. 1, with the attachment edge 20 being filed so that it can blend in with the natural nail 12.

Figure 17:
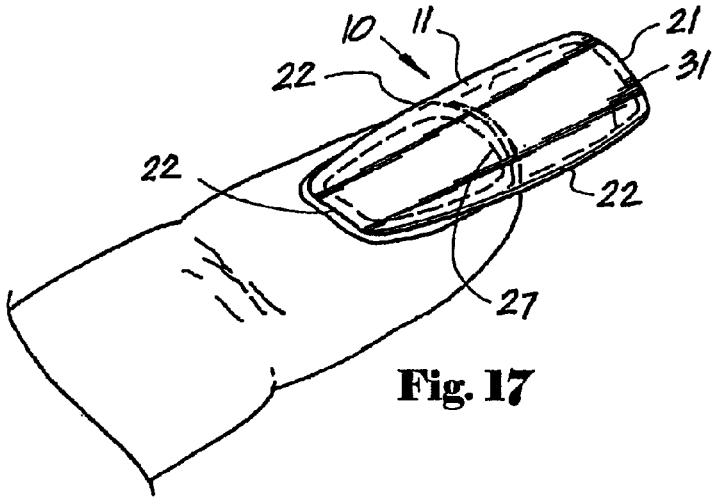
FIG. 17 is a perspective view of the fingernail shown in FIG. 16, as it would appear when placed on a person's fingernail.

Another common word used to define the nail 18 is a "full cover," where the nail 18 covers the entire portion of the natural nail 12, as shown in FIG. 17. The nail 18 and secondary sheet 40 are layered together with a central portion on the surface area of the inner or underneath side 16, and a portion of the secondary sheet 40 defining a cavity 30.

Figure 2:
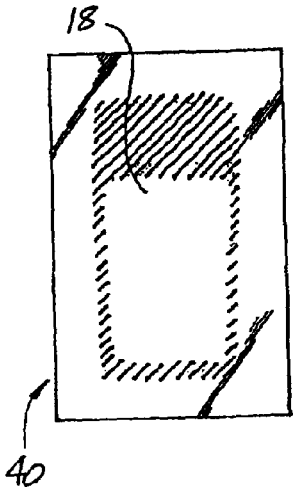
FIG. 2 is a perspective view showing the attachment fingernail placed underneath the secondary sheet.
Figure 3:
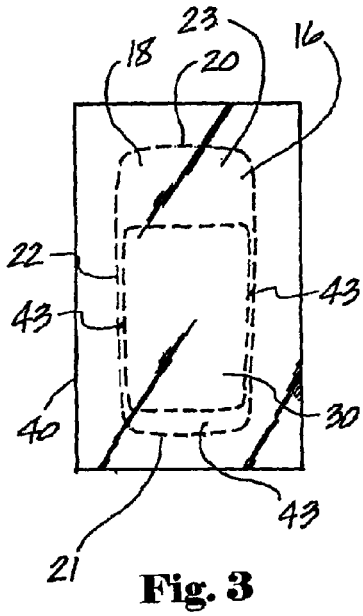
FIG. 3 is a bottom view of the attachment fingernail as shown underneath the secondary sheet, with the intended cavity area defined.
Figure 4:
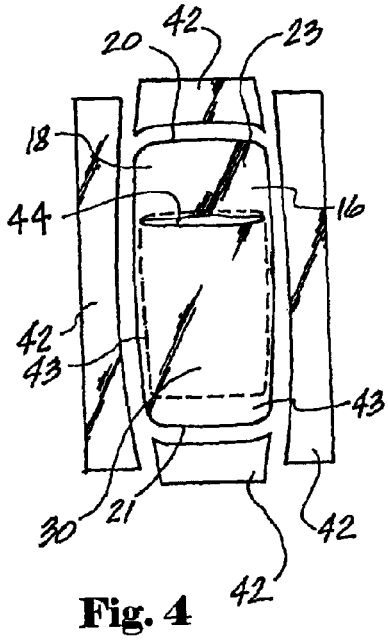
FIG. 4 is a bottom view of the attachment fingernail, with the secondary sheet affixed thereto, showing the excess portions of the secondary sheet having been removed.

Referring now also to FIGS. 2-4, the cavity 30 is formed by placing the fingernail 18 alongside a secondary sheet 40, so that the flat sides of both the nail 18 and the sheet 40 are parallel to each other and are in close proximity to each other. The inner or underneath side 16 should face the flattened side of the secondary sheet 40. Both the nail 18 and the sheet 40 are either transparent and for translucent, allowing light waves to pass through them with little effect as to the color and/or intensity of said light. The secondary sheet 40 may have a preprinted pattern or design on it, which allows it to function as a background for the cavity 30. This is particularly attractive and desirable, when the cavity 30 functions as a snow-globe, so that the background can be a particular scene.

Referring now also specifically to FIG. 3. The attachment fingernail 5 in FIG. 3 has a desired cavity 30 that occupies approximately two thirds of the available surface area of one side of the fingernail 18. In this particular situation, an unused area 23 is provided on a portion of nail close to the attachment edge 20, with the unused area 23 able to be used to fix the attachment nail 5 to the natural nail 12. The wearer may desire the unused area 23 to function as the extension portion of the attachment nail 5, and have that portion of the attachment nail 5 be that portion which is fixed to the natural nail 12.

Figure 13:
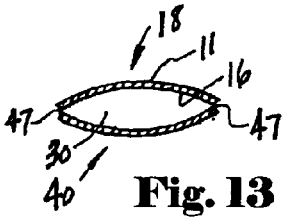
FIG. 13 depicts a cross-sectional view of the curved nail and secondary sheet of FIG. 12 joined together to form a cavity.

The area on the bottom side of the nail 18, being the peripheral area around the edge of the nail 18, comprises an adhesive area 43. Adhesive material is placed on the nail 18 on the underside 16 in area 43, which comprises the area between the limitations of cavity 30 and the edges 22 of the nail 18. The adhesive area 43 comprises the thin strip of area between the cavity 30 and the side edges 23, and the cavity 30 and peripheral edge 21 of the nail 18. Adhesive material may also be placed on the unused area 23, as indicated in FIG. 13.

Once adhesive material has been placed within the adhesive area 43, the secondary sheet 40 is moved against the flat side of the nail 18, being the underneath side 16 allowing the secondary sheet to adhere to the nail 18, along the area defined as the adhesive area 43, and/or the unused area 23. The resulting cavity 30 is defined by the inner side 16 of the nail 18, and the secondary sheet 40 in the area where there is no adhesive material.

Figure 9:
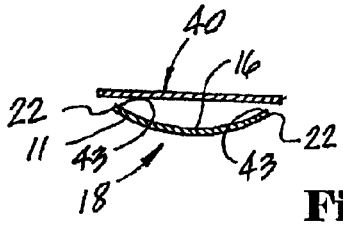
FIG. 9 is a cross sectional view of how the attachment fingernail and secondary sheet are positioned adjacent to each other prior to contact between them.
Figure 10:
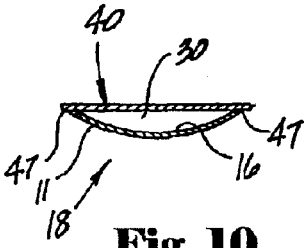
FIG. 10 is a cross sectional view showing the attachment fingernail and secondary sheet, and indicating their contact points common between them.
Figure 11:
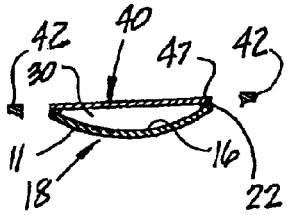
FIG. 11 is a cross sectional view of the fingernail and secondary sheet, that have been joined, with the excess portion removed.

As is shown in FIG. 4, the secondary sheet 40 is typically larger than the fingernail 18, allowing for proper adhesion within the adhesive areas 43. Referring now also to FIG. 9, the fingernail 18 comprises an arcual shape when viewed in a cross-sectional manner, with adhesive areas 43 defined along this inner side 16 adjacent to the side edges 22. A secondary sheet 40 is shown in FIGS. 9, 10 and 11 and as a flat sheet having the ability to maintain its flat orientation during its interaction with the curved nail 18.

As the curved nail 18 and the secondary sheet 40 are brought together, they will make contact along the adhesive areas creating an adhered area 47, comprising a portion of the fingernail 18 and sheet 40 that physically make contact with each other. As is also shown in FIG. 10, an enclosed cavity 30 is defined by the inner side 16 of fingernail 18, and the secondary sheet 40.

The excess sheet material 42 is removed, by simply cutting it off, so that the resulting nail 18 and secondary sheet 40 combination has the same original shape from a top or bottom view as the nail 18 did by itself previously. As is also shown in FIG. 4, there may be a substantial amount of sheet excess 42, and in either case, the extra material, being the excess sheet portion 42, is removed. As is also shown in FIG. 4, a slit 44 is defined along one side edge of the defined cavity 30. Said slit 44 comprising the opening or mouth into the cavity 30.

Figure 5:
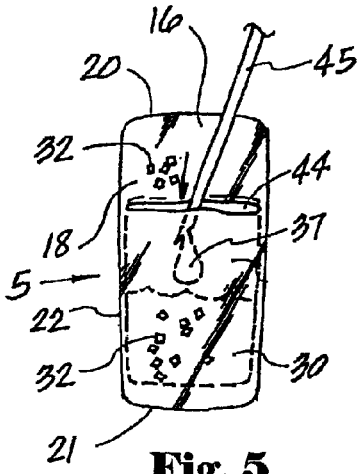
FIG. 5 is a view of the attachment fingernail, showing a needle that has been inserted through the slit opening, with the suspension matrix being injected through the needle into the cavity.

The slit 44 allows the insertion of a liquid delivery means, which is indicated in FIG. 5 as a hollow needle 45. As FIG. 5 shows, the liquid delivery means 45 injects a suspension matrix 37 into the cavity 30. The suspension matrix 37 may be comprised of any liquid substance, such as water or other more viscous substances such as gels. Likewise, the suspension matrix 37 may be comprised of individual colors that are desirable for injection into the cavity 30, for purely ornamental means.

Figure 16:
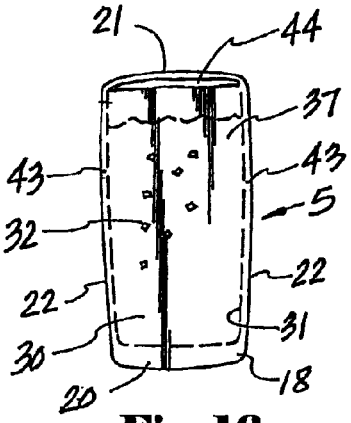
FIG. 16 is a top view of an attachment fingernail, in which the cavity extends the length of the fingernail.

In situations where the cavity 30 is desirable to include virtually the entire available surface area of the nail 18, the adhesive area 43 comprises the flat area adjacent to edges 20, 21 and 22. Placement of the secondary sheet 40 against such a nail 18 causes the secondary sheet 42 to adhere along the areas around the peripheral sides of the nail 18, with a slit 44 defined along one of the edges. FIG. 16 shows the slit 44 adjacent to the peripheral edge 21. It should be understood that the slit 44 may be at any other point along the defined cavity wall 31, including the attachment edge 20 area. In situations where the nail 18 and secondary sheet 40 both comprise resilient materials, the nail 18 and secondary sheet 40 may exhibit the same characteristics, and be effectively mirror images of one another, such as that shown in FIGS. 12 and 13.

Figure 6:
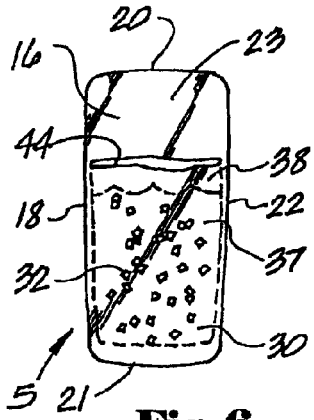
FIG. 6 depicts the attachment fingernail, showing the cavity nearly fill with the suspension matrix and glitter.
Figure 18:
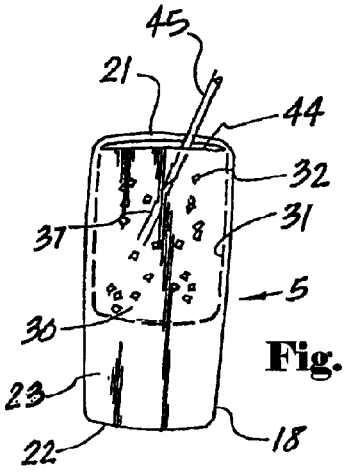
FIG. 18 is a view of an attachment fingernail and secondary sheet from the underneath bottom side of the nail: in which the slit opening is adjacent to the peripheral edge.
Figure 19:
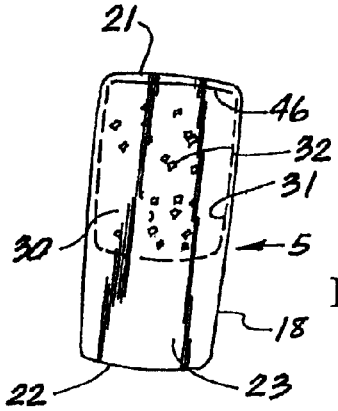
FIG. 19 is a view of an attachment fingernail and secondary sheet from the underneath bottom side of the nail, as shown in FIG. 18, with the slit opening closed to form a closure.

Likewise, the slit 44 may be on the peripheral edge 21, as shown in FIG. 18, as opposed to the attachment edge 20 indicated in FIGS. 4-6. The only appreciable difference in the attachment nail 5 shown in FIG. 18 from that shown in FIGS. 4-6 is the location of the slit 44. As is shown in FIG. 19, once the slit 44 is closed, a closure area 46 is created, sealing in the contents of the cavity 30. Further, it should be understood that the unused area 23 may be used as that portion of the attachment nail 5 that is directly attached to the natural nail 12 as shown in FIG. 1, or where it effectively functions as the actual extension portion as shown in FIG. 17.

In addition to the suspension matrix 37, particulate matter 32 may also be introduced into the cavity 30 in conjunction with a suspension matrix 37. The particular matter in FIGS. 5, 6 and 7 comprises glitter 32 which is allowed to move freely within the cavity 30, throughout the suspension matrix 37 contained therein.

Once the desirable amount of suspension matrix 37 and any desired particulate matter 32 has been added to the cavity 30, the injector means, as is exampled by the hollow point needle 45 is withdrawn. An air pocket 38 may be defined above the suspension matrix 37, as shown in FIG. 6. The open slit 44 is closed and sealed, with the mouth edges of the slit 44 joining together and either adhesively closed or affected in some manner so that the mouth of the slit 44 closes to prevent any of the contents within the cavity 30 from escaping. Air pockets 38 may be desirable, or may be excluded, through the action in involved in the closure, in which the volume of the cavity 30 is limited into the volume of the matrix 37 it contains.

Figure 7:
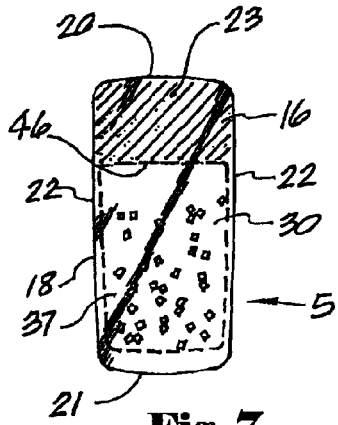
FIG. 7 depicts the attachment fingernail, indicating that the cavity has been filled and the slit opening sealed to form a closure.
Figure 8:
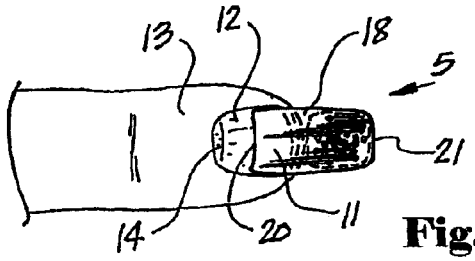
FIG. 8 is a top view of the attachment fingernail as shown as it would appear when placed on a person's finger.

As FIGS. 7 and 19 show, a completed attachment fingernail 5 is shown, in which the unused area 23 may provide a suitable area in which the attachment nail 5 can be fixed securely to a natural fingernail 12 as shown in FIG. 1, or where the unused area 23 may provide the actual extension portion as shown in FIG. 17. Referring also to FIGS. 7 and 17, the cavity 30 in FIG. 7 may be situated so that it is above the natural nail 12, with the unused area 23 actually being that portion that extends out from the natural nail 12. FIG. 17 indicates two possible cavity sizes, one with a full cavity wall 31, where the cavity 30 is both above the natural nail 12, and extends outward beyond the natural nail 12, and also a smaller cavity 30 where the partial cavity wall 27 limits the expanse of the cavity 30 to that portion of the attachment nail 5 that is above the natural fingernail 12. The fingernail 5 shown in FIG. 7 could have the intended cavity 30 for either the orientation as shown in FIG. 1, or as the partial cavity 30 as shown in FIG. 17, where the cavity 30 defined by the partial cavity wall 27.

Figure 12:
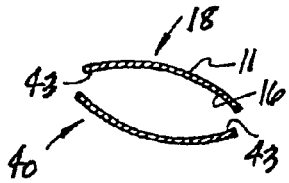
FIG. 12 depicts a replacement fingernail and oppositely curved secondary sheet, both shown adjacent to each other.

Referring now also to FIGS. 12 and 13, these two Figures contrast the difference between a curved nail 18, and a similarly curved secondary sheet 40, where the curvature of the nail 18 and sheet 40 are opposite to each other, creating a convex shaped cavity 30 between them when they are urged together. As FIG. 12 indicates, an adhesive area 43 may be on the nail inner surface 16, on the secondary sheet 40, or on both the nail 18 and secondary sheet 40.

Figure 14:
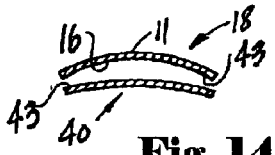
FIG. 14 depicts a variation of this invention, showing a curved nail and a curved secondary sheet, where both the sheet and nail exhibit similar curvature, where the nail has a greater degree of curvature than the sheet.
Figure 15:
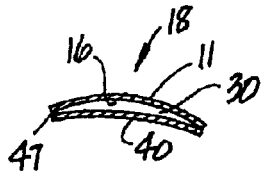
FIG. 15 depicts a cross-sectional view of the curved nail and curved secondary sheet, as seen in FIG. 14, that have been joined together to form a cavity.

Another variation is shown in FIGS. 14 and 15, in which the nail 18 is shown having a defined degree of curvature on its inner side 16, so that said degree of curvature exceeds the degree of curvature of the secondary sheet 40. When the nail 18 and sheet 40, as shown in FIG. 14, are brought together, they create an adhered portion 47, with the inner surface 16 of nail 18 and a secondary sheet 40 creating an arcual cavity 30.

The first variation shown in FIGS. 9, 10, and 11, may comprise a rigid nail 18 and a flexible or rigid secondary sheet 40. Likewise, the nail 18 and secondary sheet 40 as shown in FIGS. 12 and 13, and FIGS. 14 and 15 may comprise a rigid or flexible material. In all three variations, a single cavity 30 is formed, allowing introduction of other objects into said cavity 30.

The size of the cavity 30 may vary as to width, such as the wider cavity 30 shown in FIG. 15, as compared with FIG. 13. Also, the length of the cavity 30 may cover a portion of the total area of the nail 18, as shown in FIGS. 1-8, or may include virtually the entire nail 5, as shown in FIGS. 16, and 17.

Figure 20:
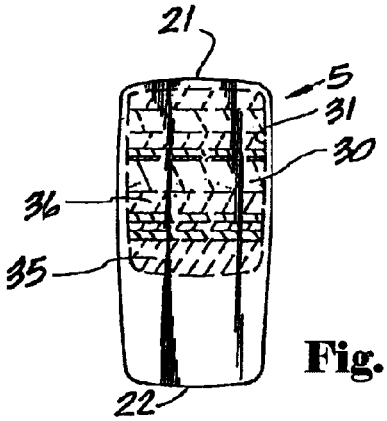
FIG. 20 is a top view of the attachment fingernail, in which the cavity has been filled with various layers of granular matter to form bands of colored patterns.

Referring now also to FIG. 20, particulate matter may be introduced into the cavity 30, where fine particulate matter such as sand may be added. With this type of material use, there is generally no suspension matrix 37, since the sand is an added with different colors being added at different times to form desirable patterns and/or stripes. As is indicated in FIG. 20, assuming that slit 44 was defined along the peripheral edge 21, different layers of sand could be added, with each layer being subsequently added on the other, so that the observable color of a particular layer of sand 35 would be different than the subsequent layer of sand added 36, with other multiple layers possible. This creates the ability to utilize the cavity 30 to create unique fingernails 5 that are virtually incapable of being reproduced in an identical decorative manner.

Figure 21:
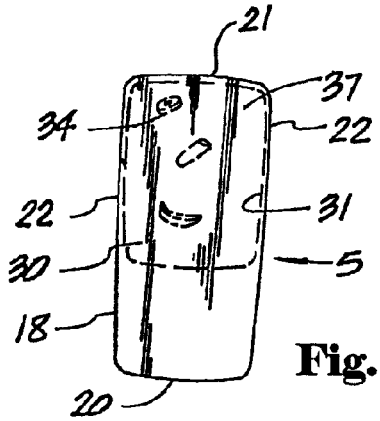
FIG. 21 is a top view of the attachment fingernail showing the cavity and indicating ornamental objects contained within said cavity.

Also referring to FIG. 21, a suspension matrix 37 may be placed in the cavity 30, with various ornamental objects 34 of non uniform shapes and sizes. Such objects 34 may comprise such items as beads, small cylindrical pieces, or even desirable small ornamental shapes. The suspension matrix 37 allows these objects to perform similarly as the glitter 32 does in the cavities 30 previously discussed above. It is also possible that no suspension matrix 47 be added, so that the ornamental objects 34 are able to move freely within the cavity 30.

Figure 22:
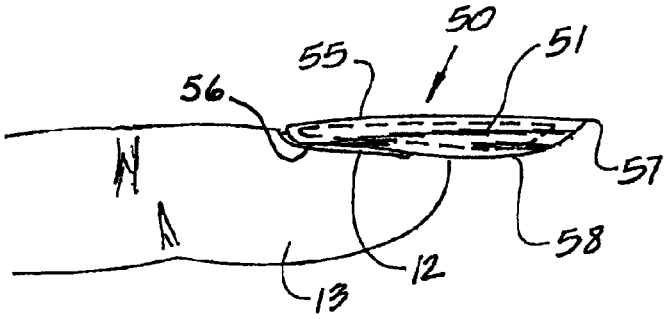
FIG. 22 is a side view of a finger and single piece nail, shown as it would appear when attached to a person's finger.

Referring now also to FIG. 22, a single piece nail 50 is shown, as it appears when mounted on a person's finger 13. The single piece nail 50 has a cutaneous side 56, which is intended for attachment to the natural nail 12 of a person's finger 13, with the external side 55 available for viewing, or the application of glazes, or other items and substances as desired.

Figure 27:
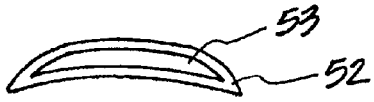
FIG. 27 is a cross sectional view of the single piece nail.

The single piece nail 50 may be formed as a single unit during the manufacturing stage or it may be the combination of two or more separate pieces that are formed or joined together to form a completed rigid nail structure, as is shown in FIGS. 12-15. The single piece nail 50, unlike the attachment nail 10 presents a rigid contiguous side wall 52, as shown in FIG. 27. The cavity 53 is therefore consistent in shape and size, during the usable life of the single piece nail 50.

Figure 23:
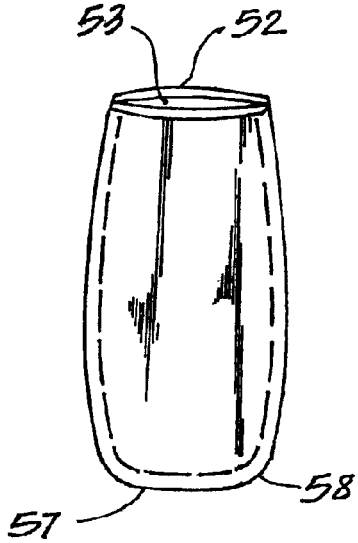
FIG. 23 is a view of the single piece nail as it would appear from a top view, showing the opening to the cavity prior to any plug being placed within said cavity.

Referring also to FIGS. 23 and 27, the single piece nail 50 has a defined tip 57, which is intended to supplant the normal nail edge of a natural nail 12, however the single piece nail 50 provides an extended tip 57 so as to give the appearance of a longer fingernail 12.

The single piece nail 50 also has a lip 58, that defines the outer peripheral edge of said nail 50, with the end opposite of the tip 57 defining an opening 53, where the opening 53 allows access to the cavity 51. The cavity 51 is generally the entire width and height of the nail 50, less the appreciable dimensions of the side wall 52. The cavity 51 may also comprise a smaller size, where the side wall 52 has a greater thickness, or where the defined size and shape of the cavity 51 varies according to the manner in which it is manufactured. Said cavity 51 could therefore comprise the entire available area across the width of the nail 50, or a portion of the nail 50, so that the cavity 51 may comprise a partial cavity, or a cavity with a particular and desirable shape. Access to the cavity 51 is through the opening 53.

Figure 24:
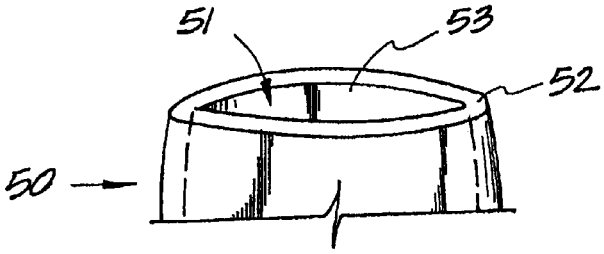
FIG. 24 is a perspective partial view of the single piece fingernail showing the cavity opening and sidewall of the single piece nail.
Figure 25:
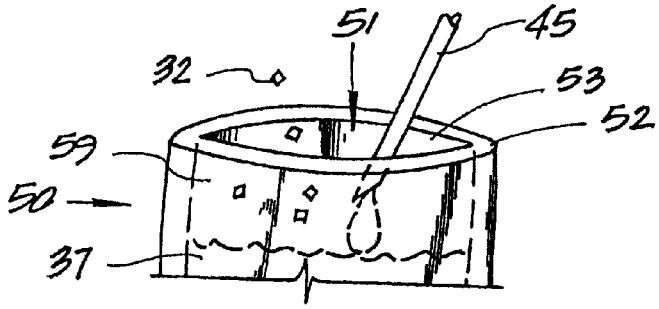
FIG. 25 is a perspective partial view of the single piece nail, showing a needle as it injects fluid into the cavity, as well as glitter being directed through the opening into the cavity.

An enlarged view of the opening 53 is shown in FIG. 24, in which the opening 53 is defined by the side wall 52, where the side wall 52 defines a generally circular shape. The cavity 51 is able to receive any substance desired, by inserting said substance through the opening 53 into the cavity 51. FIG. 25 examples the use of a needle 45, which injects the suspension matrix 37 into the cavity 51. Solid items, such as glitter 32 may also be placed into the cavity 51 through the opening 53, in the same manner as described above in the attachment fingernail 5.

Figure 26:
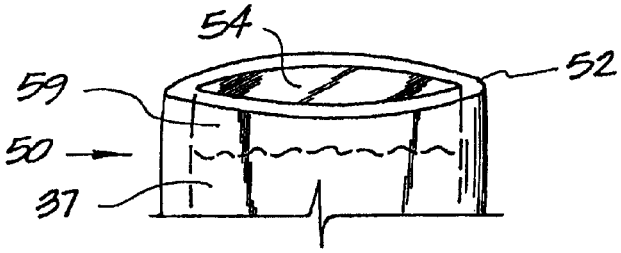
FIG. 26 is a perspective partial view of the single piece nail, showing the plug after it has been placed into the opening, to seal the cavity.

Once the desired substances or items are placed into the cavity 51, the opening 53 is sealed using a plug 54, which comprises a resilient substance that is capable of bonding with the defined sides and shape of the opening 53, so as to fill in all available space across the opening, thus sealing in the contents of the cavity 51. As is shown in FIG. 26, an available airspace 59 may also be present within the sealed cavity 51, providing a moving bubble as the nail 50 is turned and rotated. It should be understood that the examples of items described above for the attachment nail 5, comprising particulate matter such as sand 35, gels, objects 34, and other substances are usable in the single piece nail 50 in the same manner as the attachment nail 5. Both the attachment nail 5 and the single piece nail 50 provide similar decorative nails that are able to be attached as the typical decorative nails commonly known and understood in the art. The single piece nail 5 may contain within its cavity desired liquids, clear or colored, gels, visually reflective decorative items, as well as mixtures of glitter 32 in a suspension matrix 37. Further, the cavity 51 may define a volume greater than the volume of matrix 37 it contains, so that an air pocket 59, also referred to as gas bubbles are defined within said cavity 51.

From the foregoing statements, summary, and description, in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

What is claimed is:

1. A method for decorating a natural nail, comprising:

providing a substantially clear base nail having an attachment portion attachable to a natural nail, an extension portion which extends beyond a terminating edge of the natural nail when the attachment portion is attached to the natural nail, and a bottom surface;

attaching a secondary sheet to the bottom surface of the base nail to form a cavity between the extension portion of the base nail and the secondary sheet, to leave the bottom surface of the attachment portion of the base nail exposed for attachment to the natural nail, and to provide an opening into the cavity;

inserting at least one opaque decorative element into the cavity via the opening;

inserting a volume of fluid into the cavity via the opening so as to cause the opaque decorative element to be suspended in the fluid;

sealing the opening to maintain the opaque decorative element and the volume of fluid within the cavity whereby the opaque decorative element is visible solely through the extension portion of the base nail; and attaching the bottom surface of the attachment portion of the base nail to the natural nail such that the cavity formed between the extension portion of the base nail and the secondary sheet extends entirely beyond the terminating edge of the natural nail in a substantially coextensive relationship to the natural nail.

2. A method of decorating a natural nail, comprising:

providing a substantially clear nail body having an attachment portion attachable to the natural nail, a nail extension portion which extends beyond a terminating edge of the natural nail when the attachment portion is attached to the natural nail, a cavity formed solely within the extension portion of the nail body, and an opening in communication with the cavity;

inserting at least one opaque decorative element into the cavity via the opening;

inserting a volume of fluid into the cavity, via the opening, so as to cause the opaque decorative element to be suspended in the fluid;

sealing the opening to maintain the opaque decorative element and the volume of fluid within the cavity whereby the opaque decorative element is visible solely through the nail extension portion of the nail body; and attaching the attachment portion of the base nail to the natural nail such that the cavity of the nail extension portion extends entirely beyond the terminating edge of the natural nail in a substantially coextensive relationship relative to the natural nail.

3. A method of decorating a natural nail, comprising:

providing a decorative nail, comprising:

substantially clear nail body having a nail attachment portion attachable to the natural nail and a nail extension portion which extends beyond a terminating edge of the natural nail when the nail attachment portion is attached to the natural nail, the nail body having a cavity formed therein solely within the nail extension portion;

a volume of fluid disposed in the cavity; and at least one opaque decorative element suspended in the fluid so as to be visible through the nail extension portion of the nail body; and attaching the nail attachment portion of the base nail to the natural nail such that the cavity of the nail extension portion extends entirely beyond the terminating edge of the natural nail in a substantially coextensive relationship relative to the natural nail.

* * * * *